US010014592B2

(12) United States Patent
Chien

(10) Patent No.: US 10,014,592 B2
(45) Date of Patent: Jul. 3, 2018

(54) ANTENNA

(71) Applicant: GEMTEK TECHNOLOGY CO., LTD., Hsinchu County (TW)

(72) Inventor: Hsiao-Ching Chien, Hsinchu County (TW)

(73) Assignee: GEMTEK TECHNOLOGY CO., LTD., Hsinchu County (TW)

( * ) Notice: Subject to any disclaimer, the term of this patent is extended or adjusted under 35 U.S.C. 154(b) by 309 days.

(21) Appl. No.: 14/938,860

(22) Filed: Nov. 12, 2015

(65) Prior Publication Data

US 2016/0204521 A1 Jul. 14, 2016

Related U.S. Application Data

(60) Provisional application No. 62/101,387, filed on Jan. 9, 2015.

(51) Int. Cl.
*H01Q 21/30* (2006.01)
*H01Q 21/26* (2006.01)
(Continued)

(52) U.S. Cl.
CPC ..... *H01Q 21/30* (2013.01); *H01Q 21/26* (2013.01); *H01Q 1/246* (2013.01); *H01Q 9/0435* (2013.01); *H01Q 9/285* (2013.01)

(58) Field of Classification Search
CPC ..... H01C 21/30
(Continued)

(56) References Cited

U.S. PATENT DOCUMENTS 6,211,841 B1 * 4/2001 Smith ..... H01Q 1/246 343/797
7,053,832 B2 * 5/2006 Manzione ..... H01Q 21/065 343/700 MS (Continued)

OTHER PUBLICATIONS

P. Li and K. M. Luk, "Novel Wideband Dual-frequency Patch Antenna Array for Dual-polarization Operation", APMC 2005 Proceedings, IEEE.

(Continued)

*Primary Examiner* — Dameon E Levi
*Assistant Examiner* — Walter Davis
(74) *Attorney, Agent, or Firm* — CKC & Partners Co., Ltd.

(57) ABSTRACT

An antenna includes a high band configuration, a low band configuration, and two signal integration modules. The high band configuration includes two three-dimensional feed-ins and a resonator. The three-dimensional feed-ins respectively receive first band signals perpendicular to each other. The resonator is disposed above the three-dimensional feed-ins and is coupled with the three-dimensional feed-ins. The orthogonal projection of the resonator at least partially overlaps with the three-dimensional feed-ins. The low band configuration includes two dipole feed-ins. The dipole feed-ins is disposed above the high band configuration and respectively receives second band signals perpendicular to each other. The signal integration modules are electrically connected to the high band configuration and the low band configuration and integrate the first band signals and the second band signals into broadband signals. By the aforementioned configuration, the antenna receives signals in two directions perpendicular to each other and with broadband.

17 Claims, 6 Drawing Sheets

(51) Int. Cl.
*H01Q 1/24* (2006.01)
*H01Q 9/04* (2006.01)
*H01Q 9/28* (2006.01)

(58) Field of Classification Search
USPC ..... 343/727
See application file for complete search history.

(56) References Cited

U.S. PATENT DOCUMENTS

| | | | | |
|---|---|---|---|---|
| 7,994,985 | B2 * | 8/2011 | Luk | H01Q 9/0457 343/700 MS |
| 2008/0042903 | A1 * | 2/2008 | Cheng | H01Q 9/0485 343/700 MS |
| 2010/0194643 | A1 | 8/2010 | Petros | |

OTHER PUBLICATIONS

"Novel Wideband Dual-frequency L-probe Fed Patch Antenna and Array", the thesis which submitted by Li Pei to Department of Electronic Engineering City University of Hong Kong, May 2006.

* cited by examiner

ANTENNA

CROSS-REFERENCE TO RELATED APPLICATION

This application claims the priority benefit of U.S. Provisional Application Ser. No. 62/101,387, filed Jan. 9, 2015, the full disclosures of which are incorporated herein by reference.

BACKGROUND

1. Technical Field

The present disclosure relates to an antenna, and more particularly, to a broadband antenna.

2. Description of Related Art

An antenna is an electronic device for transmitting or receiving radio waves, or broadly speaking, electromagnetic waves. The antenna is used in systems such as radio/television broadcasting, wireless communications, radar, and space exploration. The antenna usually works in the atmosphere or outer space, but also works under water. In some frequencies, the antenna can even work in the soil and the rocks.

Theoretically, the antenna is a combination of one or more conductors. The antenna can generate electromagnetic waves by imposing an alternative voltage or an alternative current. An alternative voltage can also be generated at a terminal of the antenna from electromagnetic induction in case the antenna is placed in the electromagnetic field.

SUMMARY

This disclosure provides antenna to receive signals with wide bands in two orthogonal directions.

In one aspect of the disclosure, an antenna is provided. The antenna includes a substrate, at least one high band configuration, a low band configuration, a first signal integration module, and a second signal integration module. The high band configuration includes a first three-dimensional feed-in, a second three-dimensional feed-in, a resonator, a first feed-in trace, and a second feed-in trace. The first three-dimensional feed-in is disposed on the substrate and configured to receive a first band signal parallel to a first horizontal direction. The second three-dimensional feed-in is disposed on the substrate and configured to receive the first band signal parallel to a second horizontal direction, in which the first horizontal direction is orthogonal to the second horizontal direction. The resonator is disposed above the first three-dimensional feed-in and the second three-dimensional feed-in and configured to be coupled with the first three-dimensional feed-in and the second three-dimensional feed-in, in which an orthogonal projection of the resonator at least partially overlaps the first three-dimensional feed-in and the second three-dimensional feed-in. The first feed-in trace is disposed on the substrate and electrically connected to the first three-dimensional feed-in. The second feed-in trace is disposed on the substrate and electrically connected to the second three-dimensional feed-in. The low band configuration includes a first dipole feed-in and a second dipole feed-in. The first dipole feed-in is disposed above the high band configuration and configured to receive a second band signal parallel to the first horizontal direction. The second dipole feed-in is disposed above the high band configuration and configured to receive the second band signal parallel to the second horizontal direction. The first signal integration module is electrically connected to the first feed-in trace and the first dipole feed-in and configured to integrate the first band signal and the second band signal parallel to the first horizontal direction into a first broadband signal. The second signal integration module is electrically connected to the second feed-in trace and the second dipole feed-in and configured to integrate the first band signal and the second band signal parallel to the second, horizontal direction into a second broadband signal.

In one or more embodiments, the first three-dimensional feed-in includes an upright portion connected to the first feed-in trace and a horizontal portion connected to the upright portion.

In one or more embodiments, when a shape of the horizontal portion is a rectangle, the horizontal portion is parallel to the first horizontal direction.

In one or more embodiments, a shape of the resonator is approximately point symmetric in a vertical direction.

In one or more embodiments, the resonator is a three-dimensional structure.

In one or more embodiments, a shape of the resonator is a sphere, a triangle cone, a quadrangle cone a polygonal cone or a horn.

In one or more embodiments, the resonator includes a first sub-resonator and a second sub-resonator. An orthogonal projection of the first sub-resonator at least partially overlaps the first three-dimensional feed-in and the second three-dimensional feed-in. The second sub-resonator is disposed above the first sub-resonator, in which an orthogonal projection of the second sub-resonator at least partially overlaps the first sub-resonator.

In one or more embodiments, shapes of the first sub-resonator and the second sub-resonator are disks.

In one or more embodiments, the first feed-in trace and the second feed-in trace are horizontally disposed on the substrate.

In one or more embodiments, the first dipole feed-in is parallel to the first horizontal direction, and the second dipole feed-in is parallel to the second horizontal direction.

In one or more embodiments, the number of the high band configurations is two, the substrate has a first edge, a second edge, a third edge, and a fourth edge, the first edge and the third edge are parallel to the first horizontal direction, the second edge and the fourth edge are parallel to the second horizontal direction, the first edge and the second edge form a first corner, the third edge and the fourth edge form a second corner, the high band configurations are respectively disposed on the first corner and the second corner, and an orthogonal projection of the first dipole feed-in and an orthogonal projection of the second dipole feed-in do not overlap the first three-dimensional feed-ins, the second three-dimensional feed-ins, and the resonators of the high band configurations.

In one or more embodiments, the number of the high band configurations is four, the substrate has a first edge, a second edge, a third edge, and a fourth edge, the first edge and the third edge are parallel to the first horizontal direction, the second edge and the fourth edge are parallel to the second horizontal direction, the high band configurations are respectively disposed on four corners of the substrate, and an orthogonal projection of the first dipole feed-in and an orthogonal projection of the second dipole feed-in do not overlap the first three-dimensional feed-ins, the second three-dimensional feed-ins, and the resonators of the high band configurations.

In one or more embodiments, the number of the high band configurations is four, the first signal integration module is electrically connected to the first feed-in traces of two of the high band configurations and the first dipole feed-in, and the second signal integration module is electrically connected to the second feed-in traces of two of the high band configurations and the second dipole feed-in. The low band configuration further includes a third dipole feed-in and a fourth dipole feed-in. The third dipole feed-in is disposed above the high band configurations and configured to receive the second band signal parallel to the first horizontal direction. The fourth dipole feed-in is disposed above the high band configurations and configured to receive the second band signal parallel to the second horizontal direction. The antenna further includes a third signal integration module and a fourth signal integration module. The third signal integration module is electrically connected to the first feed-in traces of the other two of the high band configurations and the third dipole feed-in and configured to integrate the first band signal and the second band signal parallel to the first horizontal direction into a third broadband signal. The fourth signal integration module is electrically connected to the second feed-in traces of the other two of the high band configurations and the fourth dipole feed-in and configured to integrate the first band signal and the second band signal parallel to the second horizontal direction into a fourth broadband signal.

In one or more embodiments, four edges of the substrate are respectively parallel to the first horizontal direction and the second horizontal direction, the high band configurations are respectively disposed on four corners of the substrate, and an orthogonal projection of the first dipole feed-in, an orthogonal projection of the second dipole feed-in, an orthogonal projection of the third dipole feed-in, and an orthogonal projection of the fourth dipole feed-in do not overlap the first three-dimensional feed-ins, the second three-dimensional feed-ins, and the resonators of the high band configurations.

In one or more embodiments, the first dipole feed-in, the second dipole feed-in, the third dipole feed-in, and the fourth dipole feed-in are stripe-shaped or dumbbell-shaped, the substrate has a first edge, a second edge, a third edge, and a fourth edge, the first edge and the third edge are parallel to the first horizontal direction, and the second edge and the fourth edge are parallel to the second horizontal direction.

In one or more embodiments, the first three-dimensional feed-in is made of a metal or a dielectric material.

In one or more embodiments, the resonator is made of a metal or a dielectric material.

The first three-dimensional feed-in and the second three-dimensional feed-in of the high band configuration respectively receive the first band signals parallel to the first horizontal direction and the second horizontal direction, and the first dipole feed-in and the second dipole feed-in of the low band configuration respectively receive the second band signals parallel to the first horizontal direction and the second horizontal direction. Then, the first signal integration module integrates the first band signal and the second band signal parallel to the first horizontal direction into the first broadband signal. The second signal integration module integrates the first band signal and the second band signal parallel to the second horizontal direction into the second broadband signal. Therefore, the antenna can receive signals with wide bands in two orthogonal directions.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Figure 1:
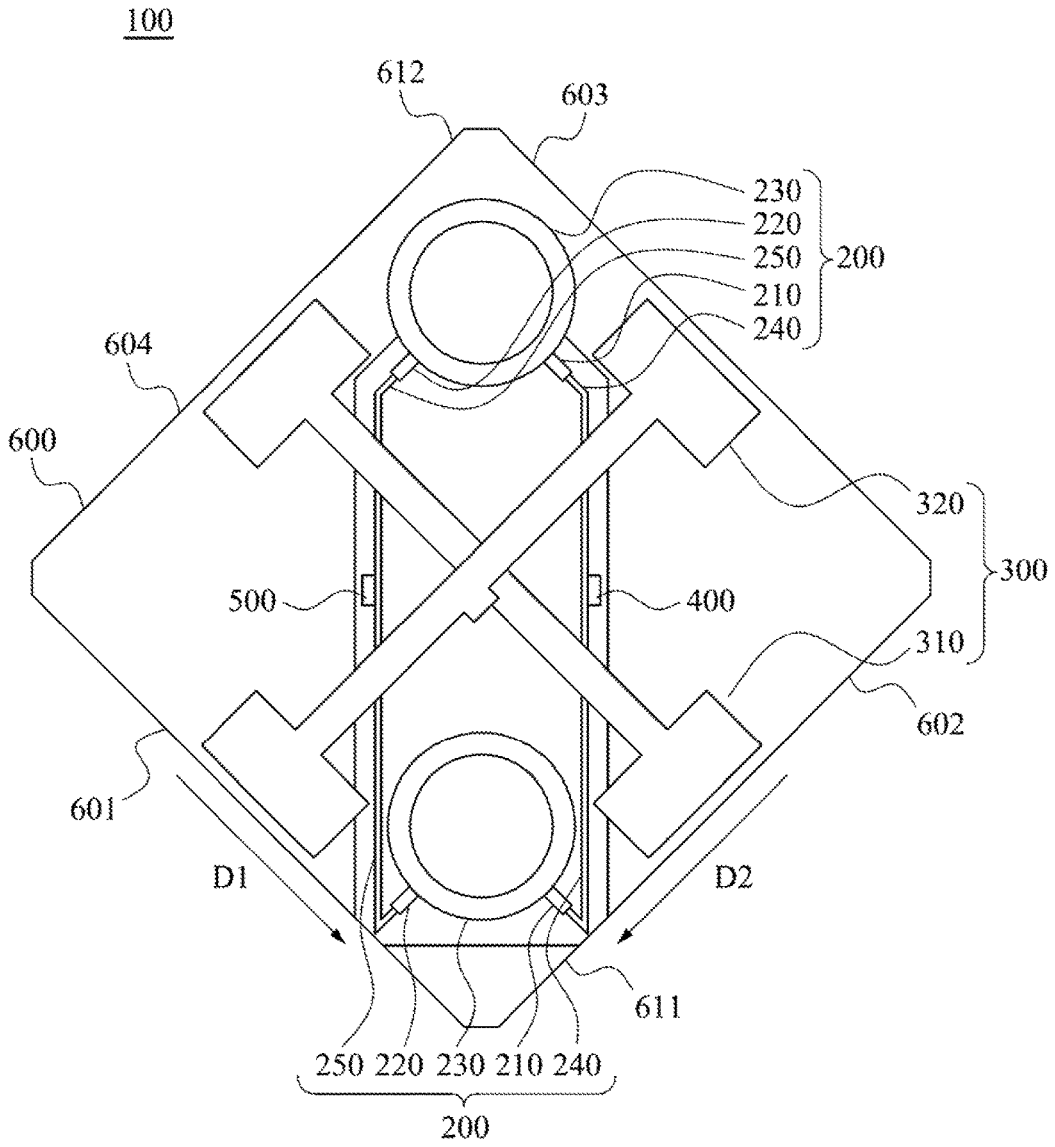
FIG. 1 is a schematic top view of an antenna according to one embodiment of this invention.
Figure 2:
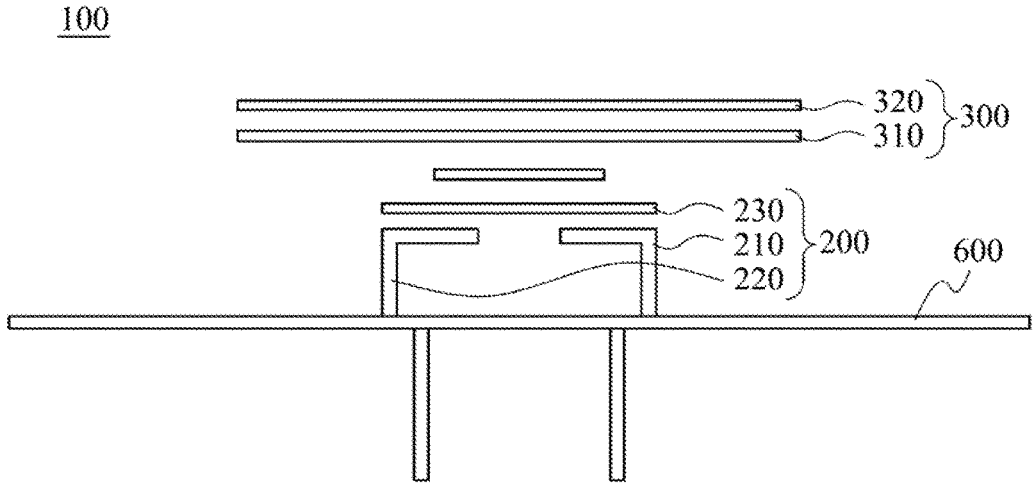
FIG. 2 is a schematic side view of the antenna according to one embodiment of this invention.

FIG. 1 is a schematic top view of an antenna 100 according to one embodiment of this invention. FIG. 2 is a schematic side view of the antenna 100 according to one embodiment of this invention. The antenna 100 is provided. The antenna 100 can be an indoor or outdoor directional broadband antenna, such as a base station for 4G wireless broadband communication.

As shown in FIG. 1 and FIG. 2, the antenna 100 includes a substrate 600, at least one high band configuration 200, a low band configuration 300, a first signal integration module 400, and a second signal integration module 50*a* The high band configuration 200 includes a first three-dimensional feed-in 210, a second three-dimensional feed-in 220, a resonator 230, a first feed-in trace 240, and a second feed-in trace 250. The first three-dimensional feed-in 210 is disposed on the substrate 600 and configured to receive a first band signal parallel to a first horizontal direction D1. The second three-dimensional feed-in 220 is disposed on the substrate 600 and receives the first band signal parallel to a second horizontal direction D2, in which the first horizontal direction D1 is orthogonal to the second horizontal direction D2. The resonator 230 is disposed above the first three-dimensional feed-in 210 and the second three-dimensional feed-in 220 and coupled with the first three-dimensional feed-in 210 and the second three-dimensional feed-in 220, in which an orthogonal projection of the resonator 230 at least partially overlaps the first three-dimensional feed-in 210 and the second three-dimensional feed-in 220. The first feed-in trace 240 is disposed on the substrate 600 and electrically connected to the first three-dimensional feed-in 210. The second feed-in trace 250 is disposed on the substrate 600 and electrically connected to the second three-dimensional feed-in 220. The low band configuration 300 includes a first dipole feed-in 310 and a second dipole feed-in 320. The first dipole feed-in 310 is disposed above the high band configuration 200 and receives a second band signal parallel to the first horizontal direction D1. The second dipole feed-in 320 is disposed above the high band configuration 200 and receives the second band signal parallel to the second horizontal direction D2. The first signal integration module 400 is electrically connected to the first feed-in trace 240 and the first dipole feed-in 310 and integrates the first band signal and the second band signal parallel to the first horizontal direction D1 into a first broadband signal. The second signal integration module 500 is electrically connected to the second feed-in trace 250 and the second dipole feed-in 320 and integrates the first band signal and the second band signal parallel to the second horizontal direction D2 into a second broadband signal.

The first three-dimensional feed-in 210 and the second three-dimensional feed-in 220 of the high band configuration 200 respectively receive the first band signals parallel to the first horizontal direction D1 and the second horizontal direction D2, and the first dipole feed-in 310 and the second dipole feed-in 320 of the low band configuration 300 respectively receive the second band signals parallel to the first horizontal direction D1 and the second horizontal direction D2. Then, the first signal integration module 400 integrates the first band signal and the second band signal parallel to the first horizontal direction D1 into the first broadband signal. The second signal integration module 500 integrates the first band signal and the second band signal parallel to the second horizontal direction D2 into the second broadband signal. Therefore, the antenna 100 can receive signals with wide bands in two orthogonal directions. Specifically, the antenna 100 is a dual-polarized antenna, and the bandwidth ratio is larger than or equals to 45% (the definition of the bandwidth ratio is the ratio of the bandwidth with return loss less than 10% in the entire bandwidth).

Because the low band configuration 300 receives the signals with greater wavelengths, there should be a larger space around the low band configuration 300 for effectively receiving signals. Therefore, the low band configuration 300 is disposed above the high band configuration 200, such that there is an enough space between the low band configuration 300 and the substrate 600 for effectively receiving signals. In addition, because the low band configuration 300 uses a dipole configuration with a simple structure, the overall size of the antenna 100 can be effectively minimized. Specifically, if the band of the antenna is higher than 1.7 GHz, for example, 1.8 GHz, 3 GHz, 4 GHz, the height of the antenna 100 can be less than or equals to 38 mm, and the length and the width of the antenna 100 can be less than or equals to 210 mm. If the band of the antenna 100 is a lower band, the height of the antenna 100 can be greater than 38 mm, and the length and the width of the antenna 100 can be greater than 210 mm (the height, the length, and the width of the antenna may be about 0.1 times the wavelengths of the band, and the length of the diagonal of the substrate 600 is greater than or equals to one times the wavelengths of the high band signal).

Figure 3:
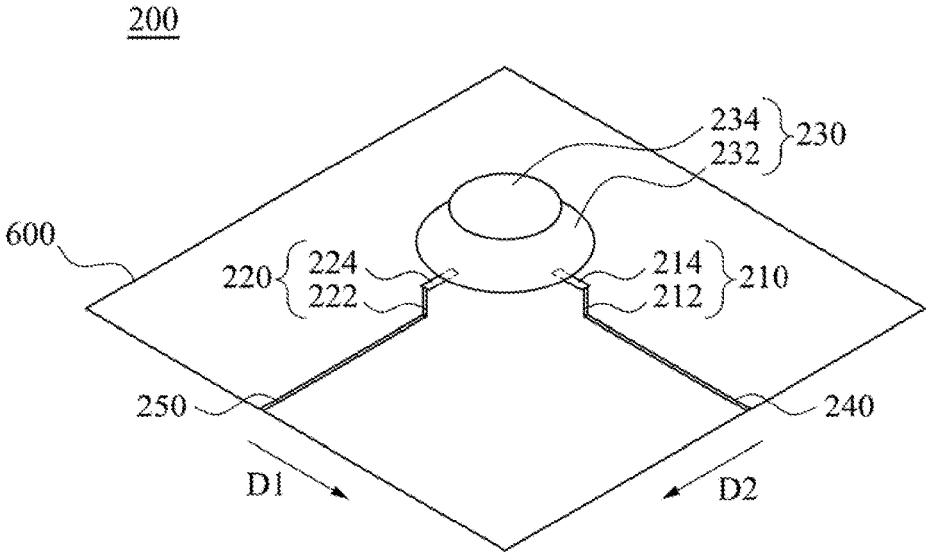
FIG. 3 is a schematic perspective view of a high band configuration according to one embodiment of this invention.
Figure 4:
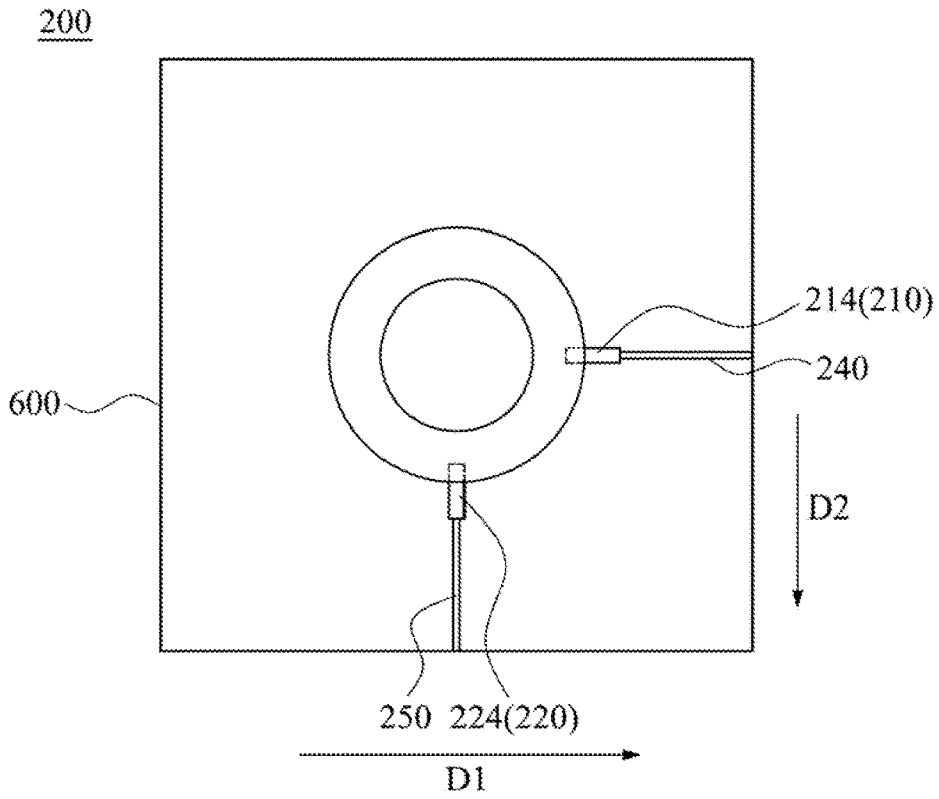
FIG. 4 is a schematic top view of the high band configuration according to one embodiment of this invention.
Figure 5:
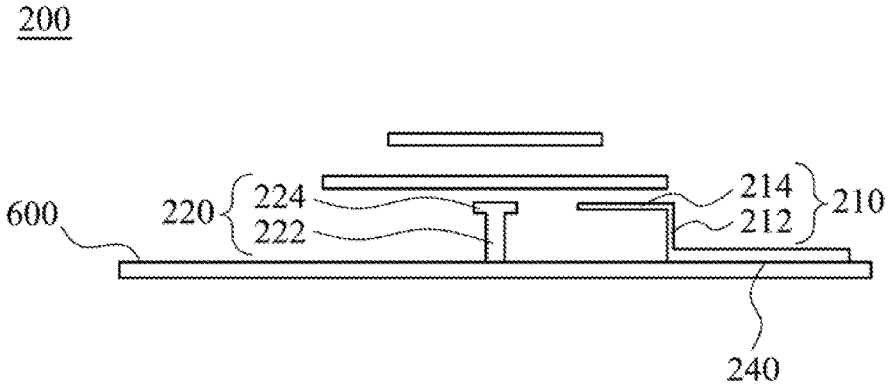
FIG. 5 is a schematic side view of the high band configuration according to one embodiment of this invention.

FIG. 3 is a schematic perspective view of a high band configuration 200 according to one embodiment of this invention. FIG. 4 is a schematic top view of the high band configuration 200 according to one embodiment of this invention. FIG. 5 is a schematic side view of the high band configuration 200 according to one embodiment of this invention. As shown in FIG. 3, FIG. 4, and FIG. 5, the first three-dimensional feed-in 210 includes an upright portion 212 connected to the first feed-in trace 240 and a horizontal portion 214 connected to the upright portion 212. The second three-dimensional feed-in 220 includes an upright portion 222 connected to the second feed-in trace 250 and a horizontal portion 224 connected to the upright portion 222.

Specifically, the shape of the horizontal portions 214 and 224 is a rectangle. The horizontal portion 214 is parallel to the first horizontal direction D1, and the horizontal portion 224 is parallel to the second horizontal direction D2. Embodiments of this disclosure are not limited thereto. People having ordinary skill in the art can make proper modifications to the horizontal portions 214 and 224 depending on the actual application.

Specifically, the first three-dimensional feed-in 210 is made of a metal or a dielectric material, and the second three-dimensional feed-in 220 is made of a metal or a dielectric material. Embodiments of this disclosure are not limited thereto. People having ordinary skill in the art can make proper modifications to the first three-dimensional feed-in 210 and the second three-dimensional feed-in 220 depending on the actual application.

The shape of the resonator may be approximately point symmetric in a vertical direction, and the resonator may be a three-dimensional structure. In this embodiment, the resonator 230 includes a first sub-resonator 232 and a second sub-resonator 234. An orthogonal projection of the first sub-resonator 232 at least partially overlaps the first three-dimensional feed-in 210 and the second three-dimensional feed-in 220. The second sub-resonator 234 is disposed above the first sub-resonator 232 and an orthogonal projection of the second sub-resonator 234 at least partially overlaps the first sub-resonator 232. Specifically, the orthogonal projection of the first sub-resonator 232 at least partially overlaps the horizontal portions 214 and 224.

Specifically, the shapes of the first sub-resonator 232 and the second sub-resonator 234 are disks. Embodiments of this disclosure are not limited thereto. In other embodiments, the shape of the resonator 230 may be a sphere, a triangle cone, a quadrangle cone, a polygonal cone or a horn.

Specifically, the resonator 230 is made of a metal or a dielectric material. Embodiments of this disclosure are not limited thereto. People having ordinary skill in the art can make proper modifications to the resonator 230 depending on the actual application.

In addition, in this embodiment, the resonator 230 only includes the first sub-resonator 232 and the second sub-resonator 234. Embodiments of this disclosure are not limited thereto. In other embodiments, the resonator 230 may include additional sub-resonator to increase the resonant modes, thereby enhancing the ability to receive signals of the high band configuration 200.

The first feed-in trace 240 and the second feed-in trace 250 are horizontally disposed on the substrate 600. Specifically, as shown in FIG. 5, the first feed-in trace 240 and the second feed-in trace 250 directly contact the substrate 600. Embodiments of this disclosure are not limited thereto. In other embodiments, there may be a gap between the first feed-in trace 240 and the substrate 600, and there may be a gap between the second feed-in trace 250 and the substrate 600. In other words, the first feed-in trace 240 and the second feed-in trace 250 are disposed above the substrate 600.

Figure 6:
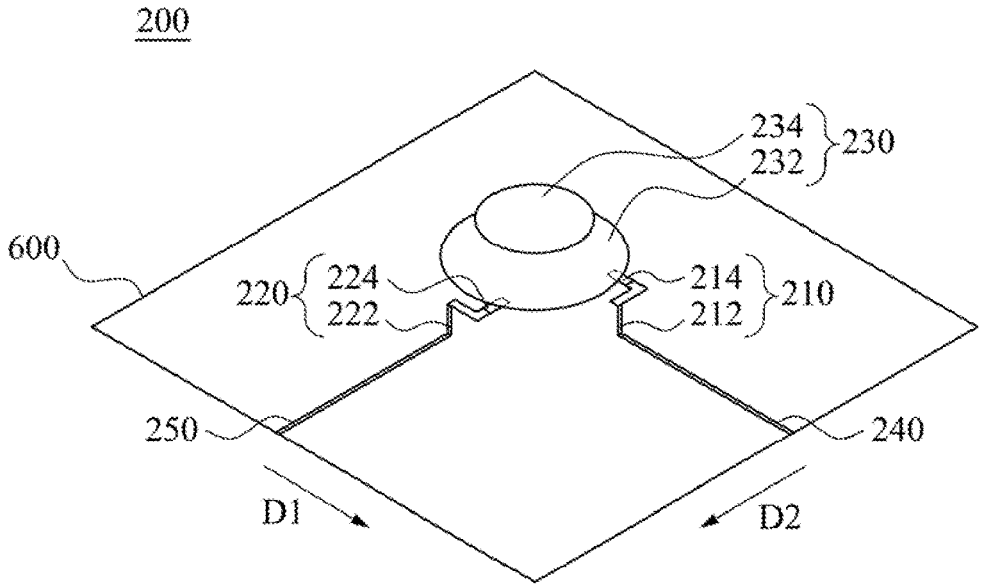
FIG. 6 is a schematic perspective view of the high band configuration according to another embodiment of this invention.

FIG. 6 is a schematic perspective view of the high band configuration 200 according to another embodiment of this invention. As shown in FIG. 6, the high band configuration 200 is similar to the high band configuration 200 of FIG. 2, and the main difference is that the shape of the horizontal portions 214 and 224 is L-shaped.

Figure 7:
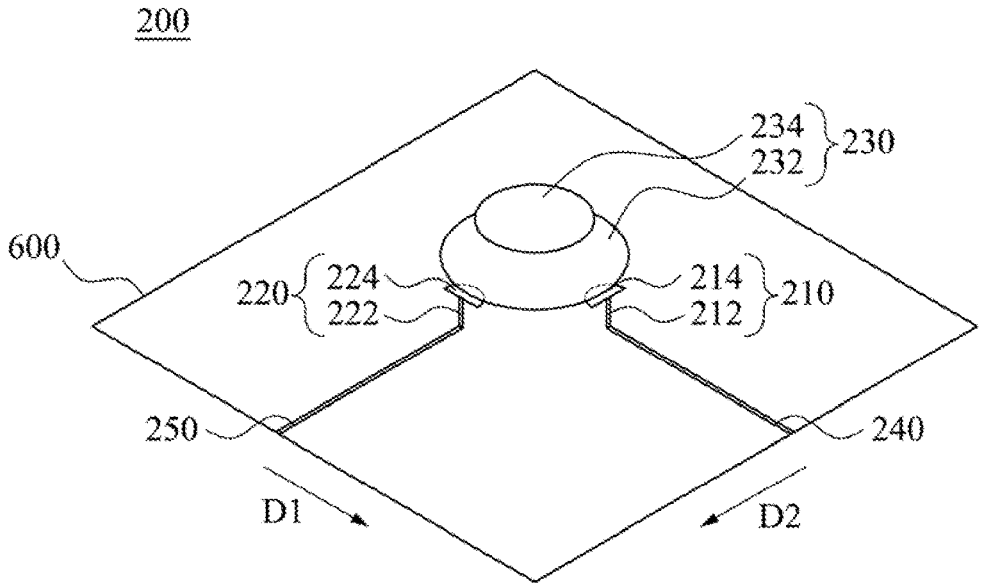
FIG. 7 is a schematic perspective view of the high band configuration according to another embodiment of this invention.

FIG. 7 is a schematic perspective view of the high band configuration 200 according to another embodiment of this invention. As shown in FIG. 7, the high band configuration 200 is similar to the high band configuration 200 of FIG. 2, and the main difference is that the shape of the horizontal portions 214 and 224 is semicircular.

Specifically, as shown in FIG. 1, the first dipole feed-in 310 and the second dipole feed-in 320 is dumbbell-shaped. The first dipole feed-in 310 is parallel to the first horizontal direction D1, and the second dipole feed-in 320 is parallel to the second horizontal direction D2. Embodiments of this disclosure are not limited thereto. In other embodiments, the shape of the first dipole feed-in 310 and the second dipole feed-in 320 may be strip-shaped.

Specifically, as shown in FIG. 1, the number of the high band configurations 200 is two. The shape of the substrate 600 is approximately a square. The substrate 600 has a first edge 601, a second edge 602, a third edge 603, and a fourth edge 604. The first edge 601 and the third edge 603 are parallel to the first horizontal direction D1, and the second edge 602 and the fourth edge 604 are parallel to the second horizontal direction D2. The first edge 601 and the second edge 602 form a first corner 611, and the third edge 603 and the fourth edge 604 form a second corner 612. The high band configurations 200 are respectively disposed on the first corner 611 and the second corner 612, and an orthogonal projection of the first dipole feed-in 310 and an orthogonal projection of the second dipole feed-in 320 do not overlap the first three-dimensional feed-ins 210, the second three-dimensional feed-ins 220, and the resonators 230 of the high band configurations 200. The first dipole feed-in 310 is aligned with a line connecting the midpoint of the second edge 602 and the midpoint of the fourth edge 604, and the second dipole feed-in 320 is aligned with a line connecting the midpoint of the first edge 601 and the midpoint of the third edge 603.

In addition, in this embodiment, the first feed-in traces 240 of the two high band configurations 200 are both electrically connected to the first signal integration module 400, and the second feed-in traces 250 of the two high band configurations 200 are both electrically connected to the second signal integration module 500. Therefore, signals received by the two high band configurations 200 are integrated by the first signal integration module 400 and the second signal integration module 500, such that the quality of the signals is effectively enhanced.

Figure 8:
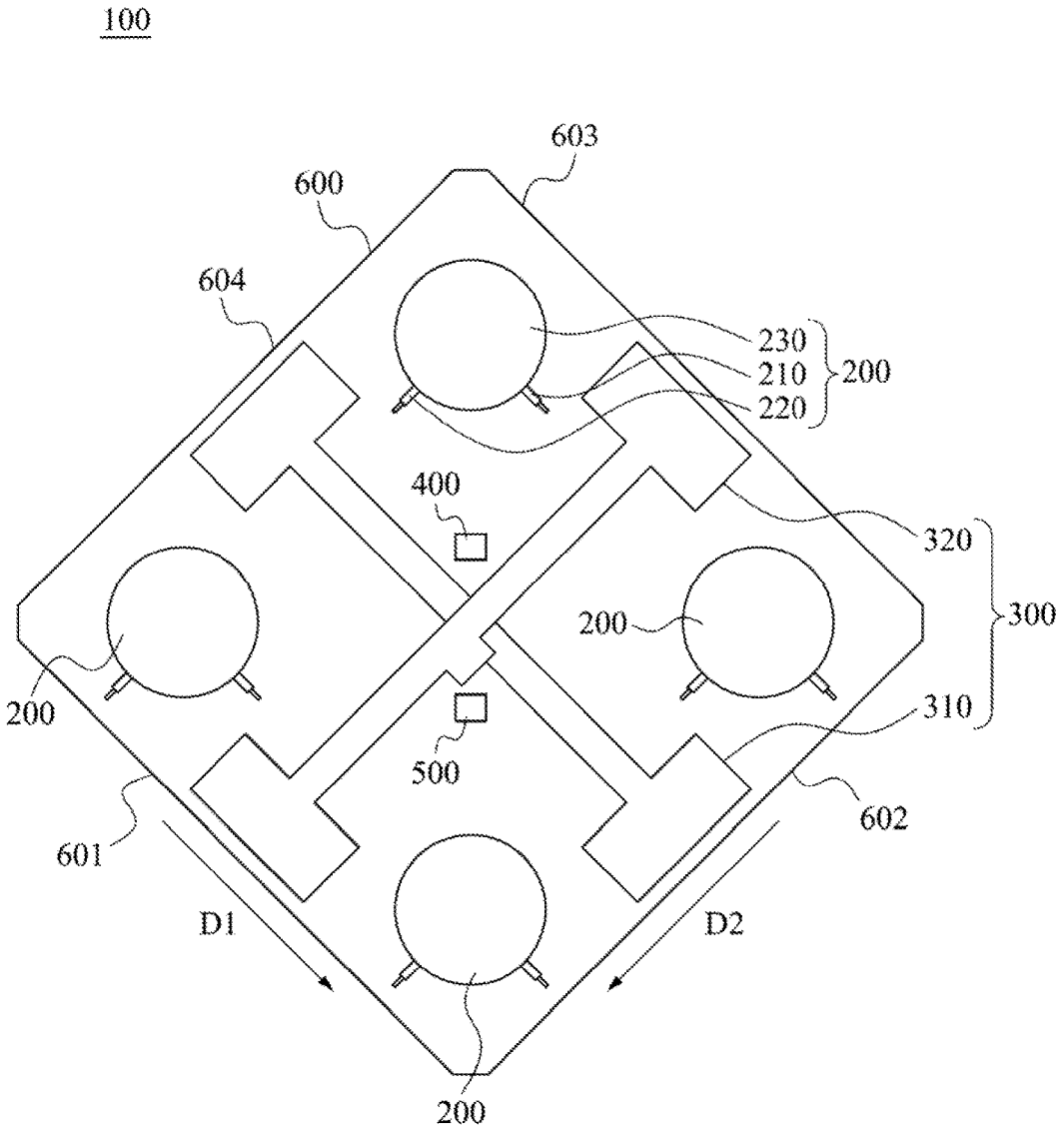
FIG. 8 is a schematic top view of the antenna according to another embodiment of this invention.

FIG. 8 is a schematic top view of the antenna 100 according to another embodiment of this invention. The antenna 100 of this embodiment is similar to the antenna 100 of FIG. 1, and the differences are described below.

As shown in FIG. 8, the number of the high band configurations 200 is four. The shape of the substrate 600 is approximately a square. The substrate 600 has a first edge 601, a second edge 602, a third edge 603, and a fourth edge 604. The first edge 601 and the third edge 603 are parallel to the first horizontal direction D1, and the second edge 602 and the fourth edge 604 are parallel to the second horizontal direction D2. The high band configurations 200 are respectively disposed on four corners of the substrate 600, and an orthogonal projection of the first dipole feed-in 310 and an orthogonal projection of the second dipole feed-in 320 do not overlap the first three-dimensional feed-ins 210, the second three-dimensional feed-ins 220, and the resonators 230 of the high band configurations 200. The first dipole feed-in 310 is aligned with a line connecting the midpoint of the second edge 602 and the midpoint of the fourth edge 604, and the second dipole feed-in 320 is aligned with a line connecting the midpoint of the first edge 601 and the midpoint of the third edge 603.

In addition, in this embodiment, the first feed-in traces (not shown in Figs.) of the four high band configurations 200 are all electrically connected to the first signal integration module 400, and the second feed-in traces (not shown in Figs.) of the four high bend configurations 200 are all electrically connected to the second signal integration module 500. Therefore, signals received by the four high band configurations 200 are integrated by the first signal integration module 400 and the second signal integration module 500, such that the quality of the signals is effectively enhanced.

Figure 9:
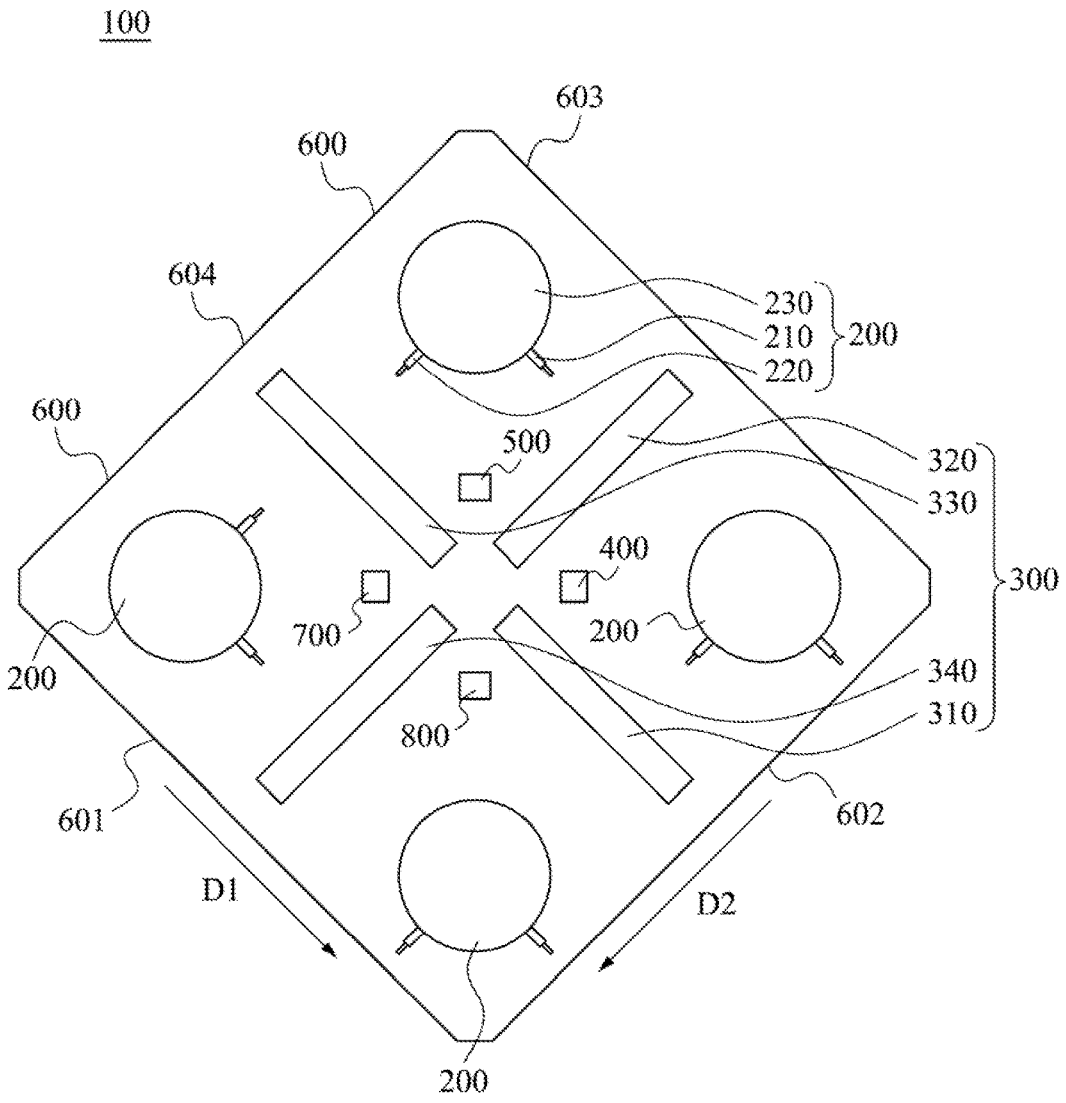
FIG. 9 is a schematic top view of the antenna according to another embodiment of this invention.

FIG. 9 is a schematic top view of the antenna 100 according to another embodiment of this invention. The antenna 100 of this embodiment is similar to the antenna 100 of FIG. 1, and the differences are described below.

As shown in FIG. 9, the number of the high band configurations 200 is four. The shape of the substrate 600 is approximately a square. The substrate 600 has a first edge 601, a second edge 602, a third edge 603, and a fourth edge 604. The first edge 601 and the third edge 603 are parallel to the first horizontal direction D1, and the second edge 602 and the fourth edge 604 are parallel to the second horizontal direction D2. The high band configurations 200 are respectively disposed on four corners of the substrate 600. The low band configuration 300 further includes a third dipole feed-in 330 and a fourth dipole feed-in 340. An orthogonal projection of the first dipole feed-in 310, an orthogonal projection of the second dipole feed-in 320, an orthogonal projection of the third dipole feed-in 330, and an orthogonal projection of the fourth dipole feed-in 340 do not overlap the first three-dimensional feed-ins 210, the second three-dimensional feed-ins 220, and the resonators 230 of the high band configurations 200.

The first dipole feed-in 10, the second dipole feed-in 320, the third dipole feed-in 330, and the fourth dipole feed-in 340 are stripe-shaped. The first dipole feed-in 310 and the third dipole feed-in 330 are aligned with a line connecting the midpoint of the second edge 602 and the midpoint of the fourth edge 604, and the second dipole feed-in 320 and the fourth dipole feed-in 340 are aligned with a line connecting the midpoint of the first edge 601 and the midpoint of the third edge 603.

The first signal integration module 400 is electrically connected to the first feed-in traces (not shown in Figs.) of two of the high band configurations 200 and the first dipole feed-in 310, and the second signal integration module 500 is electrically connected to the second feed-in traces (not shown in Figs.) of two of the high band configurations 200 and the second dipole feed-in 320. The third dipole feed-in 330 is disposed above the high band configurations and receives the second band signal parallel to the first horizontal direction D1. The fourth dipole feed-in 340 is disposed above the high band configurations 200 and receives the second band signal parallel to the second horizontal direction D2. The antenna further includes a third signal integration module 700 and a fourth signal integration module 800. The third signal integration module 700 is electrically connected to the first feed-in traces (not shown in Figs.) of the other two of the high band configurations 200 and the third dipole feed-in 330 and integrates the first band signal and the second band signal parallel to the first horizontal direction D1 into a third broadband signal. The fourth signal integration module 800 is electrically connected to the second feed-in traces (not shown in Figs.) of the other two of the high band configurations 200 and the fourth dipole feed-in 340 and integrates the first band signal and the second band signal parallel to the second horizontal direction D2 into a fourth broadband signal.

Because the first signal integration module 400, the second signal integration module 500, the third signal integration module 700, and the fourth signal integration module 800 respectively integrate different signals into the first broadband signal, the second broadband signal, the third signal broadband signal, and the fourth broadband signal, the quality of the signals are effectively enhanced, and four output signals can be provided for use.

The first three-dimensional feed-in 210 and the second three-dimensional feed-in 220 of the high band configuration 200 respectively receive the first band signals parallel to the first horizontal direction D1 and the second horizontal direction D2, and the first dipole feed-in 310 and the second dipole feed-in 320 of the low band configuration 300 respectively receive the second band signals parallel to the first horizontal direction D1 and the second horizontal direction D2. Then, the first signal integration module 400 integrates the first band signal and the second band signal parallel to the first horizontal direction D1 into the first broadband signal. The second signal integration module 500 integrates the first band signal and the second band signal parallel to the second horizontal direction D2 into the second broadband signal. Therefore, the antenna 100 can receive signals with wide bands in two orthogonal directions.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. § 112, 6th paragraph. In particular, the use of "step of" in the claims herein is not intended to invoke the provisions of 35 U.S.C. § 112, 6th paragraph.

What is claimed is:

1. An antenna, comprising:

a substrate;

at least one high band configuration, comprising:

a first three-dimensional feed-in disposed on the substrate and configured to receive a first band signal parallel to a first horizontal direction;

a second three-dimensional feed-in disposed on the substrate and configured to receive the first band signal parallel to a second horizontal direction, wherein the first horizontal direction is orthogonal to the second horizontal direction;

a resonator disposed above the first three-dimensional feed-in and the second three-dimensional feed-in and configured to be coupled with the first three-dimensional feed-in and the second three-dimensional feed-in, wherein an orthogonal projection of the resonator at least partially overlaps the first three-dimensional feed-in and the second three-dimensional feed-in, and the resonator comprises a first sub-resonator and a second sub-resonator above the first sub-resonator;

a first feed-in trace disposed on the substrate and electrically connected to the first three-dimensional feed-in; and a second feed-in trace disposed on the substrate and electrically connected to the second three-dimensional feed-in;

a low band configuration, comprising:

a first dipole feed-in disposed above the high band configuration and configured to receive a second band signal parallel to the first horizontal direction, wherein the second sub-resonator is disposed between the first dipole feed-in and the first sub-resonator; and a second dipole feed-in disposed above the high band configuration and configured to receive the second band signal parallel to the second horizontal direction;

a first signal integration module electrically connected to the first feed-in trace and the first dipole feed-in and configured to integrate the first band signal and the second band signal parallel to the first horizontal direction into a first broadband signal; and a second signal integration module electrically connected to the second feed-in trace and the second dipole feed-in and configured to integrate the first band signal and the second band signal parallel to the second horizontal direction into a second broadband signal.

2. The antenna of claim 1, wherein the first three-dimensional feed-in comprises an upright portion connected to the first feed-in trace and a horizontal portion connected to the upright portion.

3. The antenna of claim 2, wherein, when a shape of the horizontal portion is a rectangle, the horizontal portion is parallel to the first horizontal direction.

4. The antenna of claim 1, wherein a shape of the resonator is approximately point symmetric in a vertical direction.

5. The antenna of claim 1, wherein the resonator is a three-dimensional structure.

6. The antenna of claim 1, wherein a shape of the resonator is a sphere, a triangle cone, a quadrangle cone, a polygonal cone or a horn.

7. The antenna of claim 1, wherein an orthogonal projection of the first sub-resonator at least partially overlaps the first three-dimensional feed-in and the second three-dimensional feed-in, and an orthogonal projection of the second sub-resonator at least partially overlaps the first sub-resonator.

8. The antenna of claim 1, wherein shapes of the first sub-resonator and the second sub-resonator are disks.

9. The antenna of claim 1, wherein the first feed-in trace and the second feed-in trace are horizontally disposed on the substrate.

10. The antenna of claim 1, wherein the first dipole feed-in is parallel to the first horizontal direction, and the second dipole feed-in is parallel to the second horizontal direction.

11. The antenna of claim 1, wherein the number of the high band configurations is two; the substrate has a first edge, a second edge, a third edge, and a fourth edge, wherein the first edge and the third edge are parallel to the first horizontal direction, the second edge and the fourth edge are parallel to the second horizontal direction, the first edge and the second edge form a first corner, and the third edge and the fourth edge form a second corner; the high band configurations are respectively disposed on the first corner and the second corner; and an orthogonal projection of the first dipole feed-in and an orthogonal projection of the second dipole feed-in do not overlap the first three-dimensional feed-ins, the second three-dimensional feed-ins, and the resonators of the high band configurations.

12. The antenna of claim 1, wherein the number of the high band configurations is four; the substrate has a first edge, a second edge, a third edge, and a fourth edge, wherein the first edge and the third edge are parallel to the first horizontal direction, the second edge and the fourth edge are parallel to the second horizontal direction; the high band configurations are respectively disposed on four corners of the substrate; and an orthogonal projection of the first dipole feed-in and an orthogonal projection of the second dipole feed-in do not overlap the first three-dimensional feed-ins, the second three-dimensional feed-ins, and the resonators of the high band configurations.

13. The antenna of claim 1, wherein the number of the high band configurations is four, the first signal integration module is electrically connected to the first feed-in traces of two of the high band configurations and the first dipole feed-in, and the second signal integration module is electrically connected to the second feed-in traces of two of the high band configurations and the second dipole feed-in; and wherein the low band configuration further comprises:

a third dipole feed-in disposed above the high band configurations and configured to receive the second band signal parallel to the first horizontal direction; and a fourth dipole feed-in disposed above the high band configurations and configured to receive the second band signal parallel to the second horizontal direction; and further comprising:

a third signal integration module electrically connected to the first feed-in traces of the other two of the high band configurations and the third dipole feed-in and configured to integrate the first band signal and the second band signal parallel to the first horizontal direction into a third broadband signal; and a fourth signal integration module electrically connected to the second feed-in traces of the other two of the high band configurations and the fourth dipole feed-in and configured to integrate the first band signal and the second band signal parallel to the second horizontal direction into a fourth broadband signal.

14. The antenna of claim 13, wherein four edges of the substrate are respectively parallel to the first horizontal direction and the second horizontal direction, the high band configurations are respectively disposed on four corners of the substrate, and an orthogonal projection of the first dipole feed-in, an orthogonal projection of the second dipole feed-in, an orthogonal projection of the third dipole feed-in, and an orthogonal projection of the fourth dipole feed-in do not overlap the first three-dimensional feed-ins, the second three-dimensional feed-ins, and the resonators of the high band configurations.

15. The antenna of claim 13, wherein the first dipole feed-in, the second dipole feed-in, the third dipole feed-in, and the fourth dipole feed-in are stripe-shaped or dumbbell-shaped, the substrate has a first edge, a second edge, a third edge, and a fourth edge, the first edge and the third edge are parallel to the first horizontal direction, and the second edge and the fourth edge are parallel to the second horizontal direction.

16. The antenna of claim 1, wherein the first three-dimensional feed-in is made of a metal or a dielectric material.

17. The antenna of claim 1, wherein the resonator is made of a metal or a dielectric material.

* * * * *